US006028256A

United States Patent [19]

Straubinger

[11] Patent Number: 6,028,256

[45] Date of Patent: Feb. 22, 2000

[54] PAD ASSEMBLY WITH NOVEL BACKING DISK

[76] Inventor: David J. Straubinger, 2521 E. Southport Rd., Indianapolis, Ind. 46227

[21] Appl. No.: 09/122,173

[22] Filed: Jul. 24, 1998

Related U.S. Application Data

[60] Provisional application No. 60/054,427, Aug. 1, 1997.

[51] Int. Cl.[7] ..... G10D 7/08

[52] U.S. Cl. ..... 84/385 P; 84/380 R

[58] Field of Search ..... 84/385 P, 392, 84/380 R

[56] References Cited

U.S. PATENT DOCUMENTS 4,704,939 11/1987 Straubinger ..... 84/385 P
5,417,135 5/1995 Straubinger ..... 84/385 P

*Primary Examiner*—Jeffrey Donels
*Assistant Examiner*—Shih-yung Hsieh
*Attorney, Agent, or Firm*—Edward E. Sowers

[57] ABSTRACT

Pad assemblies are described having novel backing disks, a cushion layer in contact with a surface of the backing disk, and a skin covering the cushion and at least one surface to the backing disk. The novel backing disks have a flexible outer collar that in conjunction with the cushion provides support for the pad's sealing surface and maintains an even tension on the pad's skin. Preferred embodiments providing additional support for the pad's sealing surface further utilize a backing disk having an inner collar, coaxial to the flexible outer collar, and have a cushion extending between the collars and over the inner collar. As a result of the improved support, fewer tears in the pad's skin result from repeated contacts with the tone hole and from fluctuations in the skin's moisture content.

19 Claims, 2 Drawing Sheets

PAD ASSEMBLY WITH NOVEL BACKING DISK

This application claims benefit of provisional application No. 60/054,427, filed Aug. 1, 1997.

BACKGROUND

This invention relates generally to a tone hole covering for wind instruments having a novel backing disk with an outer collar capable of flexing to relieve tension and resultant damage caused by repeated contacts with the tone hole. Preferred embodiments additionally provide improved support for the retainer that holds the pad assembly within the pad cup. Although generally applicable to all wood-wind instruments, embodiments of the present invention are especially suited for use in flutes.

During this century, instrument tone hole coverings, also called pad assemblies or simply pads, have typically comprised a cardboard backed wool felt disk covered with Goldbeater's skin, wrapped around the cardboard and glued to its backside. The pad is fixed in a pad cup mounted over an instrument tone hole on a hinged mechanism so that the tone hole is sealed when the pad is in its closed position. Although such pads can initially be made to seal well, sensitivity to its environment and lack of dimensional stability of the felt and skin causes the pad surface to lose its integrity and allow air to leak at the interface between the pad and the tone hole.

In 1987, in U.S. Pat. No. 4,704,939, a new pad was disclosed that can maintain a flat sealing surface regardless of variations in temperature, moisture, or altitude. As a result of this design, pad life is extended and closure of the tone hole consistently requires only a light touch by the musician. To accomplish these advantages, the improved pad has a semi-rigid supporting unit for the felt. The pad's design allows its surface to be tilted to fit a tone hole with a perfectly planar surface through the leveling process of triangulation or, by a wedging action, to distort the planar surface to perfectly match a damaged or imperfect tone hole.

One embodiment of the improved pads is constructed by stretching a skin across a cushion ring fitted within a recess formed between inner and outer collars on the lower radial face of a rigid backing disk having a bendable lower margin. The skin is folded around the edge of the backing disk and secured to the disk's back side. The pad is secured to its cup with a retainer comprising a washer and screw combination attached to a pad nut which is in turn attached to the bottom of the pad cup and centrally located within the cup's cavity. Upon tightening the retaining screw of the assembled unit, the flat washer forces the skin against the rigid inner collar. Other methods are also known for securing the pad assembly within the pad cup, including the usual friction held retainer utilized in French or open-hole pads.

Further improvements in pad design and methods of seating pad assemblies have been made which utilize a flexible stabilizing disk locked in an adjusted position with an adjusting agent, usually an adhesive, to support a flexible backing disk having inner and outer collars. As before, a cushion layer of uniform thickness is positioned between the inner and outer collars and the pad's sealing surface covered with a skin. Should the pad need further adjustment, the pad's surface can be made to coincide with the tone hole's surface by the usual wedging action of partial shims placed between the stabilizing and backing disks.

Although pads manufactured according to these improved designs have performed well, tears in the pad's skin covering can eventually occur on the portion of the skin that covers the semi-rigid backing disk's inner and outer collars. Replacement of pad assembly requires the installation of a new pad assembly and adjustment to conform the pad's surface to the tone hole surface and is both time consuming and expensive.

The tears are generally caused by the pad's inability to maintain an even tension on its skin during repeated contacts with the tone hole surface and during repeated expansion and contraction cycles experienced by the pad's skin caused by fluctuations in its moisture content. A backing disk and pad assembly are needed having components that can provide necessary support for the pad's sealing surface, maintain an even tension on the pad's skin and avoid tears resulting from fluctuations in moisture and repeated contacts with the tone hole surface in order to avoid the time consuming and expensive replacement of the failed pad assembly.

SUMMARY

As will become apparent from the following discussion, this invention provides for a novel backing disk and pad assembly having components capable of supporting the pad's sealing surface and avoiding tears by flexing to relieve stress caused by fluctuations of moisture and repeated contact with the tone hole. Embodiments of this invention are applicable to both closed and open-hole (French) pad assemblies.

One embodiment of the present invention is directed to a backing disk having an outer collar capable of flexing toward the disk's center. The upper edge of the flexible outer collar can be straight or preferably have an upper lip which turns inward toward the center of the backing disk or outward. Preferred upper lips turn radially inward or outward to form a curved surface to provide a generally rounded surface to support the sealing surface means in the pad assembly. A more preferred embodiment of this invention is directed to a backing disk having an flexible outer collar with an upper edge or lip that is either straight or curved, an inner collar, the two collars being about the same height and forming a recess therebetween suitable for receiving a cushion layer. The flexible outer collar's upper lip can curve either inward or outward. A still more preferred embodiment of this invention is directed to a backing disk having an outer flexible collar with an upper lip curved either inward toward the center of the backing disk or outward and an inner collar having a height less than the height of the outer flexible collar. The upper edge of the inner collars can be blunt, sharp or curved. Novel backing disks can be made from metals or plastics capable of being machined or from plastics capable of being molded. The preferred backing disks have been constructed by machining stock materials made from a variety of polymers.

A further embodiment of the present invention is directed to a pad assembly for a wind instrument with a novel backing disk having an outer flexible collar; a cushion placed against the backing disk's first or sealing surface in contact with the outer flexible collar and extending inward toward the backing disk's inner edge; and a sealing surface means covering the cushion and backing disk and fixed to the backing disk's second or back side. The upper edge or lip of the flexible outer collar can be straight or preferably curved inward toward the center of the backing disk or outward to provide a rounded surface to support the sealing surface means.

A more preferred pad assembly has a novel backing disk having an inner collar and an outer flexible collar on its first or sealing surface, the collars being approximately the same height and forming a recess therebetween; a cushion within the recess; a sealing surface means covering the cushion and backing disk and fixed to the second or back side of the backing disk. The upper edge or lip of the flexible outer collar can be straight or preferably curved inward toward the center of the backing disk or outward.

A still more preferred pad assembly has a novel backing disk having an inner collar and an outer flexible collar on its first or sealing surface forming a recess therebetween, the inner collar being shorter than the outer flexible collar; and; a cushion within the recess extending inward over the inner collar toward the center edge of the backing disk; a sealing surface means covering the cushion and backing disk and fixed to the back side of the backing disk. The upper lip of the outer flexible collar can be either straight or curved either inward or outward and the upper edge of the inner collar can be blunt, sharp or curved. When assembled with the cushion extending over the inner collar, a more dense flexible region results between the inner collar and the retainer holding the assembly within a pad cup. This more dense and flexible region in conjunction with the outer flexible collar cooperate to relieve tension caused by fluctuations in moisture and repeated impacts with the tone hole surface.

DRAWINGS

These and other features, aspects, and advantages of this invention will become better understood with regard to the following description, appended claims and accompanying drawings where:

DESCRIPTION

Figure 1:
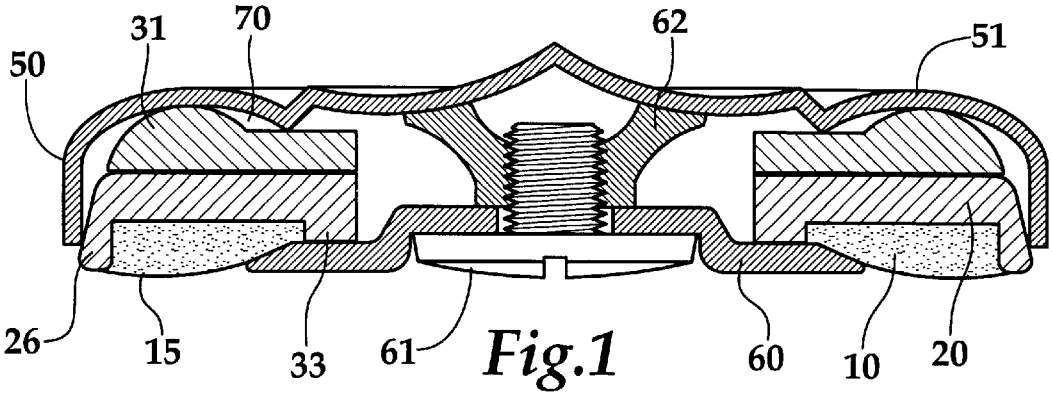
Fig.1 (PRIOR ART)
FIG. 1 illustrates a lateral view of a conventional prior art pad assembly utilizing a backing disk having rigid inner and outer collars of equal height.

For the purposes of promoting an understanding of the principles of this invention, references will now be made to several embodiments and specific language will be used to describe the same. It will nevertheless be understood that no limitation of the scope of the invention is thereby intended, such alterations and further modifications and applications of the principles of the invention as described herein being contemplated as would normally occur to one skilled in the art to which the invention relates.

This invention relates to novel backing disks and novel pad assemblies utilizing the novel backing disks. Pad assemblies incorporating the novel backing disks provide necessary support for the pad's sealing surface, maintain an even tension on the pad's skin and avoid tears resulting from fluctuations in moisture and repeated contacts with the tone hole surface.

Embodiments of this invention are applicable to both standard or closed tone hole covering assemblies and the open (French) tone hole covering assemblies. Conventional tone hole covering assemblies are composed of several components described in detail below. As used herein, the term pad cup refers to a shallow cylindrical cup having cylindrical walls and an endplate attached to one side. Closed hole assemblies have a solid endplate and a pad nut or short column centrally located within the pad cup and attached to the endplate. The endplate for an open hole assembly has a central cavity with a chimney, or short cylindrical column within the pad cup, attached to the endplate and centrally located so that cavities within the chimney and the endplate form a continuous region.

The pad assembly is composed of a backing disk and cushion layer covered by a sealing surface means generally comprising one or more layers of a sealing skin. The pad assembly is held within the pad cup by a retainer. The term retainer refers to either a washer and fastener combination having means for attaching the fastener to the pad nut and retaining the pad assembly within the closed hole pad cup. For open hole assemblies, the retainer generally comprises a friction held collar positioned within the open hole pad cup's chimney. Means for attaching the retainer's fastener to the pad nut include a) a threaded shaft sized to fit within a threaded cavity centrally located within the pad nut, b) a flanged shaft utilizing slide slits to allow for compression of the flanged region for insertion into a flanged cavity centrally located within the pad nut, and c) a ball and socket arrangement involving either a ball located on the fastener's shaft and a socket centrally located within the pad nut or a socket located at the end of the fastener's shaft and a ball located centrally on the tip of a modified pad nut opposite the endplate.

The term "second side" utilized in referring to specific sides of a stabilizing disk, an adjusting disk, or a pad assembly, refers to the side of the structure facing the pad's sealing surface when the components have been assembled and installed within the pad cup. The term "first side" similarly refers to the side of a structure facing opposite the pad's sealing surface in an assembled structure. The term rigid when applied to the backing disk's inner and outer collars indicates a condition wherein the backing disk is a component of a pad assembly installed within a pad cup and the collar does not deflect when the pad's skin contracts because of fluctuations in moisture or because of contact of the pad's sealing surface with the tone hole. The term flexible when applied to the inner and outer collars indicates a condition wherein the collar is deflected under these same conditions.

A stabilizing disk is a washer-shaped disk having at least one planar surface, an opening within the disk's central region sufficiently large to fit over the central pad nut or chimney. The stabilizing disk can be rigid or have a region located at or near the disk's circumference which can deflect sufficiently to conform the surface of its second side to the contour of the tone hole surface. The stabilizing disk can be made of metal, a polymeric material, or a combination of these materials. Stabilizing disks made from polymeric materials can be cut, machined, or molded from stock materials.

Backing disks are disks, generally washer-shaped disks having at least one planar surface capable of supporting a cushion layer covered with a skin attached to the backing disk's second or back side. Backing disks may additionally have rigid inner and outer collars forming a recess therebetween to receive the cushion layer. Novel backing disks preferred in the present invention are disks having at least one planar surface and an outer flexible collar having an upper edge or lip which is straight or curved either inward toward the center of the backing disk or outward. Preferred embodiments of the novel backing disk are washer-shaped and additionally have a rigid inner collar having a height either the same or shorter than the outer flexible collar. The upper edge of the columns can be blunt, sharp or curved. The new backing disks can be made of metal or a polymeric material. Backing disks made from polymeric materials can be cut, machined, or molded from stock materials.

The cushion utilized in pad assemblies is a washer shaped disk made from a compressible material sized to fit against the backing disk's second side in the region of the pad assembly that will contact the tone hole surface. The cushion can be constructed from any material that can be cut into rings having a uniform thickness and that is capable of both supporting the pad's sealing surface and having sufficient flexibility to conform to the tone hole's surface. Suitable cushion materials include natural materials such as wool felt and synthetic materials such as ULTRASUEDE or SCOTTFELT (mfr grade 900). ULTRASUEDE is a synthetic suede having polyester fibers impregnated with polyurethane manufactured by the Toray Co. Ltd. of Japan. SCOTTFELT is a compressed urethane foam made from a reticulated polyester polyurethane open pore foam. SCOTTFELT is a registered trademark of the Scottfoam Corporation of Eddystone, Pa.

The skin utilized to cover the cushion and backing disk is a membrane made from animal intestines. The skin is sometimes referred to as "fish skin" or "Goldbeater's skin". The skin is sensitive to moisture from the atmosphere, the musician's breath and saliva and changes its dimensions according to its moisture level.

A more detailed description of the invention follows and refers to the appended drawings. FIG. 1 shows a prior art standard pad assembly mounted in a pad cup 50 containing a stabilizing disk 31 cushioned against the pad cup's endplate 51 with an adhesive layer 70. The pad assembly comprising a backing disk 20 having rigid inner and outer coaxial collars 33 and 26, respectively forming a recess therebetween, a cushion ring 10 within the recess and a sealing surface typically a layer of a skin 15 covering the cushion and collars and fastened to the backing disk opposite the cushion and collars with an adhesive. The pad assembly is held in pad cup with a retainer which includes a washer 60 and screw 61. The stabilizing and backing disks can be rigid or flexible. Because wind instruments and flutes vary in size as do their tone holes, the dimensions of tone hole pads must vary accordingly. Generally pad cups have internal diameters ranging from about 0.300 to 0.750 inches and corresponding pad assemblies are sized to fit closely within the pad cup. The thickness of rigid coaxial collars on prior art backing disks have generally ranged from between about 0.010 and 0.020 inches and their height has generally ranged between about 0.020 and 0.030 inches.

Figure 2:
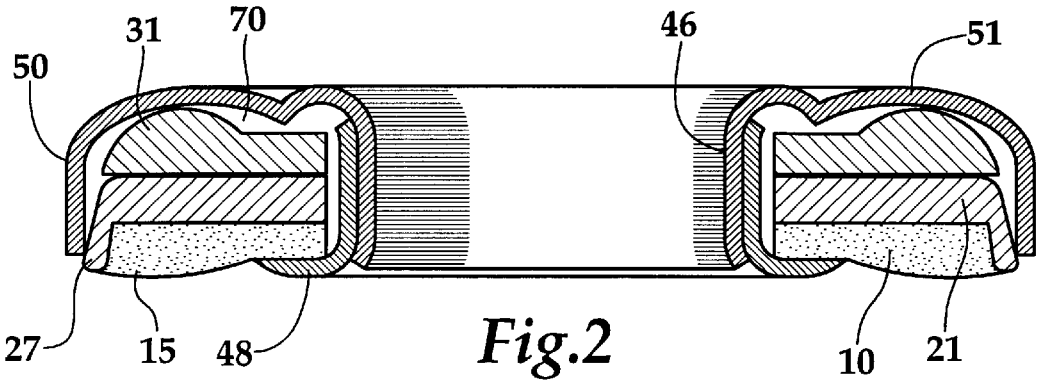
FIG. 2 illustrates lateral view of an open hole pad assembly utilizing a backing disk having an flexible outer collar.

FIG. 2 illustrates a novel open hole pad assembly mounted in a pad cup 50 containing a flexible stabilizing disk 31 cushioned against the pad cup's endplate 51 with an adhesive layer 70. Components of the novel pad assembly include a novel backing disk 21 having a flexible outer collar 27 located on the backing disk's second side, a cushion 10 in contact with the backing disk proximate the outer flexible collar and extending inward toward the inner circumference of the backing disk, and a sealing surface or skin 15 covering the cushion and flexible collar and fastened to the backing disk opposite the cushion and flexible collar with an adhesive. The pad assembly is held in place within the pad cup 50 by the friction collar 48 closely fitted within the pad cup's chimney 46.

Figure 3:
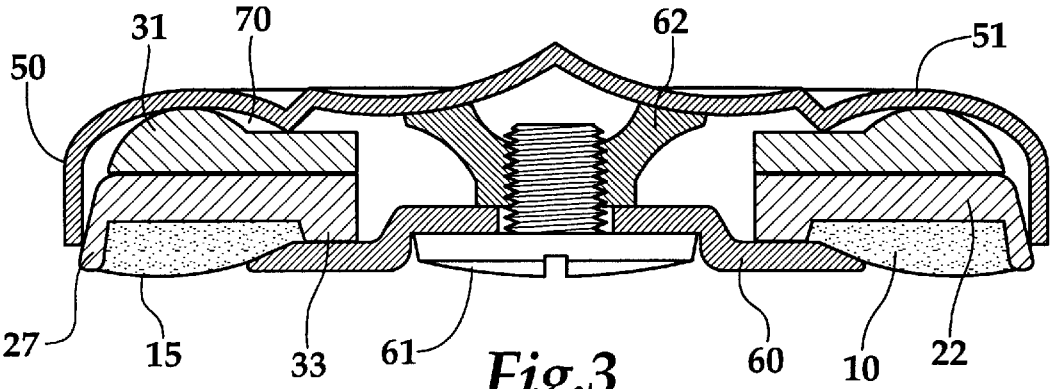
FIG. 3 shows a lateral view of a pad assembly with an improved backing disk having a flexible outer collar and a rigid inner collar.

FIG. 3 shows an embodiment of the new pad assembly mounted in a pad cup 50, the pad assembly including a novel backing disk 22 having an flexible outer collar 27 located on the backing disk's second side at its outer circumference; an inner collar 33 coaxial to the outer flexible collar; a cushion 10 located between the inner and outer collars and a skin 15 covering the collars and cushion and fastened to the backing disk's first side. The flexible outer collar 27 has a straight upper edge.

Figure 4:
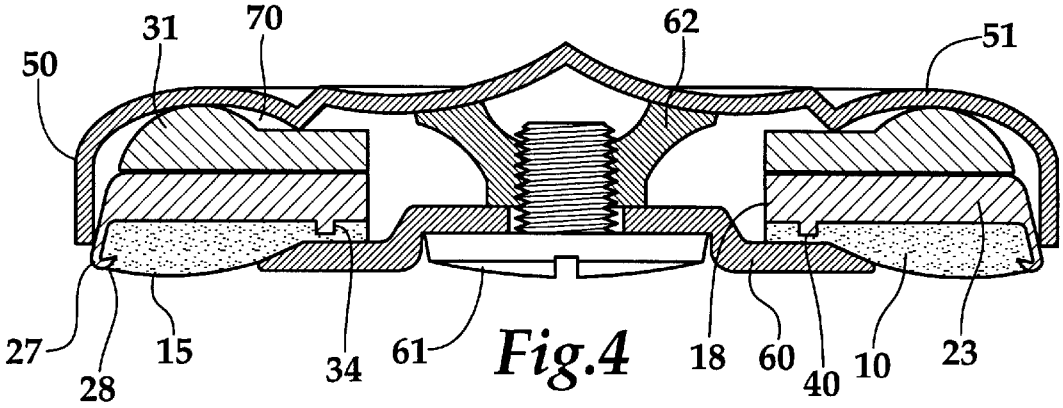
FIG. 4 shows a lateral view of a pad assembly with an improved backing disk having a flexible outer collar with an upper lip which curves inward; an inner collar having a height less than the height of the outer collar and a blunt upper edge; and a cushion extending inward over the inner collar.

FIG. 4 illustrates a further variation of the new pad assembly including a novel backing disk 23 having an outer flexible collar 27 with an upper lip 28 which curves inward toward the center of the backing disk; an inner collar 34 coaxial to the outer flexible collar and having a blunt upper edge 40; a cushion 10 positioned between the outer collar and the backing disk's inner edge 18 and extending over the inner collar.

Figure 5:
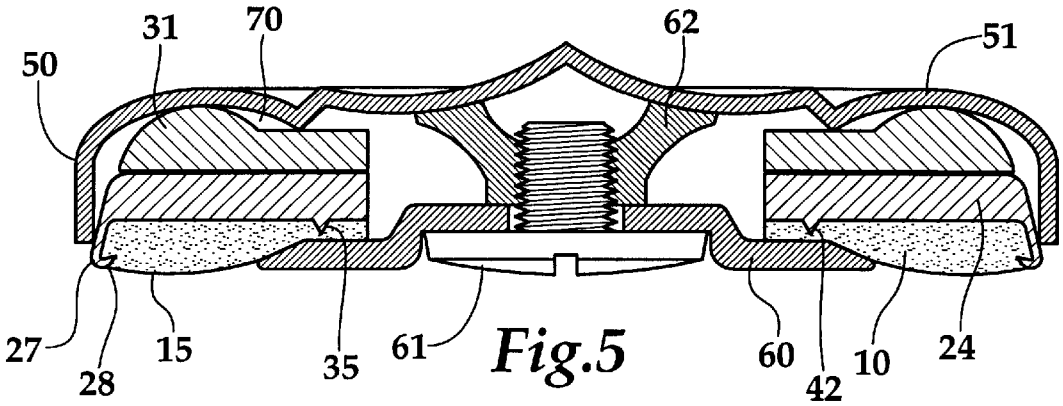
FIG. 5 illustrates a lateral view of a pad assembly with an improved backing disk having a flexible outer collar with an upper lip which curves inward; an inner collar having a height less than the height of the outer collar and a sharp upper edge; and a cushion extending inward over the inner collar.

FIG. 5 shows a new pad assembly having a backing disk with an outer flexible collar with an upper lip which curves inward and an inner collar having a sharp upper edge.

Figure 6:
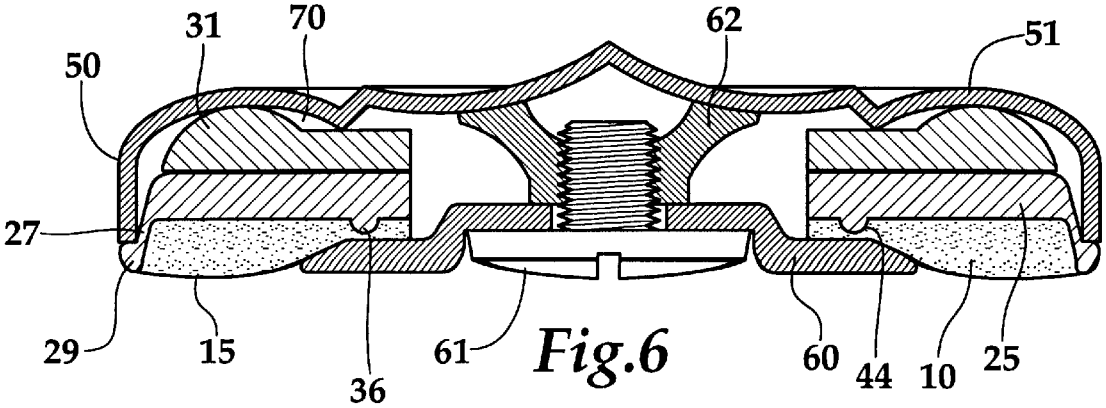
FIG. 6 illustrates a lateral view of a pad assembly with an improved backing disk having a flexible outer collar with an upper lip which curves outward; an inner collar having a height less than the height of the outer collar and a curved upper edge; and a cushion extending inward over the inner collar.

FIG. 6 illustrates a further variation of the new pad assembly where the flexible outer collar has an upper lip which curves outward away from the center of the backing disk and the inner collar has a rounded upper edge.

The novel backing disks having an outer flexible collar illustrated in FIGS. 2 through 6 can be machined from stock metal or polymeric materials or molded from reactive polymers or polymers having a sufficiently low glass transition temperature utilizing methods known to those skilled in the art. Materials that have proven particularly suitable include aluminum, polypropylene, polycarbonate, polyethylene, polyoxymethylene(acetal), and tetrafluoroethylene. The height of the flexible outer collar is dependent on the height of the cushion and generally ranges between about 0.020 and 0.031 inches. The flexible outer collar's thickness varies according to the material of construction and is determined by the amount of flexibility desired. Generally flexible outer collars range in thickness from about 0.003 to 0.015 inches. For backing disk constructed from polyoxymethylene (acetal), the flexible outer collar has a preferred thickness between about 0.005 and 0.012 inches and a more preferred thickness between 0.008 and 0.010 inches. The upper lip utilized with some flexible outer collars generally has about the same thickness as the outer collar, but can have a thickness greater or less than the outer collar. There is no minimum inward or outward extension for the outer collar's upper lip. Inward and outward extensions of up to about 0.015 inches have been utilized. The inner collar has no minimum height and its height can be as great as the height of the cushion that will lie next to it or extend over it. Inner collars with upper edges having a variety of shapes have proven effective. Upper edges that are blunt, sharp or curved have proven particularly effective.

The methods for utilizing the novel backing disks and pad assemblies disclosed and claimed herein in tone hole coverings for woodwinds, particularly flutes, and conforming their sealing surface to the tone hole are well known and have been described in the art.

This invention can be used to replace pad assemblies in older instruments and in original equipment. In addition, the invention's sealing surface can be made to conform to the tone hole surface with a variety of known techniques.

Pad assemblies having a backing disk with a flexible outer collar provide improved support for the pad's sealing surface and maintain an even tension on the pad's skin. As a result, the pad's surface retains its adjusted conformation and fewer tears in the skin result from repeated contacts with the tone hole and as a result of fluctuations in the moisture content of the skin. In addition, the more dense regions of the cushion where the cushion extends over an inner collar provide additional support for the sealing surface and further minimize tears in the skin, especially in the region where a retainer impacts the pad assembly.

I claim:

1. A backing disk for supporting the sealing surface of a wind instrument's pad assembly comprising a disk, one side of the disk having an outer flexible collar, the outer flexible collar having an upper curved lip.

2. A backing disk according to claim 1, wherein the upper curved lip curves inward.

3. A backing disk according to claim 1, wherein the upper curved lip curves outward.

4. The backing disk according to claim 1, wherein the disk has an inner collar, coaxial to the outer flexible collar, the inner and outer collars forming a recess therebetween.

5. The backing disk according to claim 4, wherein the inner collar has a blunt edge.

6. The backing disk according to claim 4, wherein the inner collar has a sharp edge.

7. The backing disk according to claim 4, wherein the inner collar has a curved edge.

8. The backing disk according to claim 4, wherein the inner collar is shorter that the outer flexible collar.

9. The backing disk according to claim 1, wherein the disk is constructed of a metal.

10. A backing disk according to claim 1, wherein the disk is constructed of a polymer material selected from the group consisting of polypropylene, polycarbonate, polyethylene, polyoxymethylene(acetal), and tetrafluoroethylene.

11. A pad for closure of a wind instrument tone hole comprising a backing disk having a first and second surface, the first surface having an outer flexible collar, the outer flexible collar having an upper curved lip; a cushion positioned against the disk's first surface, proximate the outer flexible collar; and a sealing skin, the sealing skin covering the disk's first surface, the cushion and outer flexible collar and fastened to the disk's second surface.

12. A pad according to claim 11, wherein the outer flexible collar has an upper lip, the upper lip curving inward.

13. A pad according to claim 11, wherein the disk has an inner collar, coaxial to the outer flexible collar, the inner and outer collars forming a recess therebetween.

14. A pad according to claim 11, wherein the cushion extends inward over the inner collar.

15. A pad according to claim 14, wherein the inner collar has a blunt upper edge.

16. A pad according to claim 14, wherein the inner collar has a sharp upper edge.

17. A pad according to claim 14, wherein the inner collar has a curved upper edge.

18. A pad according to claim 14, wherein the disk is constructed of a metal.

19. A pad according to claim 14, wherein the disk is constructed of a polymer material selected from the group consisting of polypropylene, polycarbonate, polyethylene, polyoxymethylene(acetal), and tetrafluoroethylene.

* * * * *